United States Patent [19]

Yasuba

[11] 3,956,525

[45] May 11, 1976

[54] METHOD OF IMPROVING THE REUSABILITY OF AN ELECTROPHOTOGRAPHIC PHOTOSENSITIVE PLATE

[75] Inventor: Hiroshi Yasuba, Jyoyo, Japan

[73] Assignee: Matsushita Electric Industrial Co., Ltd., Osaka, Japan

[22] Filed: June 14, 1974

[21] Appl. No.: 479,574

[30] Foreign Application Priority Data

June 20, 1973 Japan ..... 48-70328

[52] U.S. Cl. ..... 427/41; 96/1.5; 427/76

[51] Int. Cl.[2] ..... B05D 3/06

[58] Field of Search ..... 117/93.1 GD; 96/1.5; 427/41, 39, 83, 76

[56] References Cited

UNITED STATES PATENTS

| | | | |
|---|---|---|---|
| 3,068,510 | 12/1962 | Coleman | 117/93.1 GD |
| 3,518,108 | 6/1970 | Heiss et al. | 117/93.1 GD |
| 3,607,258 | 9/1971 | Hoegl et al. | 96/1.5 |
| 3,617,265 | 11/1971 | Petruzzella | 96/1 |

*Primary Examiner*—John H. Newsome
*Attorney, Agent, or Firm*—Wenderoth, Lind & Ponack

[57] ABSTRACT

A method of improving the reusability, in a liquid electrophoretic development process, of an electrophotographic photosensitive plate which has, in the following recited order, a base which is a conducting substrate, a thin vitreous sensitizing layer including selenium, and an organic carrier transporting layer which is polyvinylcarbazole or a polyvinylcarbazole derivative with at least one inactive additive. The main feature of the method is to apply, by glow discharge in a vacuum chamber, a top organic film on the surface of the organic carrier transporting layer.

5 Claims, 4 Drawing Figures

METHOD OF IMPROVING THE REUSABILITY OF AN ELECTROPHOTOGRAPHIC PHOTOSENSITIVE PLATE

This invention relates to a method of improving the reusability of an electrophotographic photosensitive plate for use in a liquid electrophoretic development process, and more particulary to a method of restoring the electrophotographic characteristics (inter alia residual potential) of an electrophotographic photosensitive plate to their initial values after repeated use. The plate comprises, in the following recited order, a base which is a conducting substrate, a thin vitreous sensitizing layer including selenium, and an organic carrier transporting layer of polyvinylcarbazole or a polyvinylcarbazole derivative with an inactive additive.

It is known that images may be formed and developed on the surface of certain electrophotographic photosensitive plates by electrostatic means. The basic electrophotographic process involves uniformly charging the photosensitive plate and then exposing the plate to a light and shadow image which dissipates the charge on the area of the layer which is exposed to light so as to form an electrostatic latent image. The electrostatic latent image formed on the layer corresponds to the configuration of the light and shadow image. This image is rendered visible by depositing on the image layer developing material prepared by dispersing finely ground pigments in a high insulating hydrocarbon liquid. These pigment particles acquire an electrical charge during dispersion and remain suspended in the liquid. When the electrostatic latent image of a polarity opposite to that of the dispersed particles is immersed in the pigment dispersing liquid, the pigment particles migrate to and are deposited upon the electrostatic image. This pigment image may be transferred to a paper or to other receiving surfaces. The paper then will bear the pigment image, which may subsequently be made permanent by drying or some other suitable fixing step.

In the liquid development, the developer mainly consists of the finely ground pigments and the liquid medium. As described in "Electrophotography" Focal Press Limited (1965) by R. M. Schaffert, it is required that the volume resitivity of the liquid medium be greater than $10^{10}$ ohm-cm, and the dielectric constant be less than 2.5. Known liquid media are Isopar E, Isopar G, Isopar H, Isopar K, Isopar L Isopar M (all trade names of Esso. Standard Petroleum Co.) , Shell sol 70 Shell sol 71, Shell sol *T* (all trade names of Shell Kagaku Co.), ligroin, kerosene (i.e. hydrocarbon), and Freon 113 (trade name of Du Pont), (i.e. halogenated hydrocarbon).

There is known an electrophotographic photosensitive plate comprising, in the following recited order, a base which is a conductive substrate, a thin vitreous sensitizing layer including selenium, and an organic carrier transporting layer which comprises polyvinylcarbazole or a polyvinylcarbazole derivative together with an inactive additive. The thin vitreous sensitizing layer can further include e.g. tellurium. The inactive additives are known plasticizers and/or binders which function to make the photosensitive plate mechanically tough and flexible. Such an electrophotographic photosensitive plate is advantageous because e.g. of its excellent electrophotographic characteristics and high flexibility. However, such an electrophotographic photosensitive plate still has the disadvantage such that the residual potential on the plate undesirably increases after repeated use (a long term use) in a liquid electrophoretic development process. The increase of the residual potential sometimes becomes too large. Thus, too large an increase of the residual potential is fatal to the reusability of the electrophotographic plate.

Accordingly, an object of this invention is to provide a method of improving the reusability, in a liquid electrophoretic developement process, of an electrophotographic photosensitive plate comprising, in the following recited order, a base which is a conductive substrate, a thin vitreous sensitizing layer including selenium, and an organic carrier transporting layer which comprises polyvinyl carbazole or a polyvinylcarbazole derivative together with an inactive additive.

This object is achieved according to this invention by applying, by glow discharge in a vacuum chamber, a top organic film on the surface of the organic carrier transporting layer.

These and other objects and features of this invention will be apparent upon consideration of the following detailed description taken together with the accompanying drawings, wherein.

Figure 1:
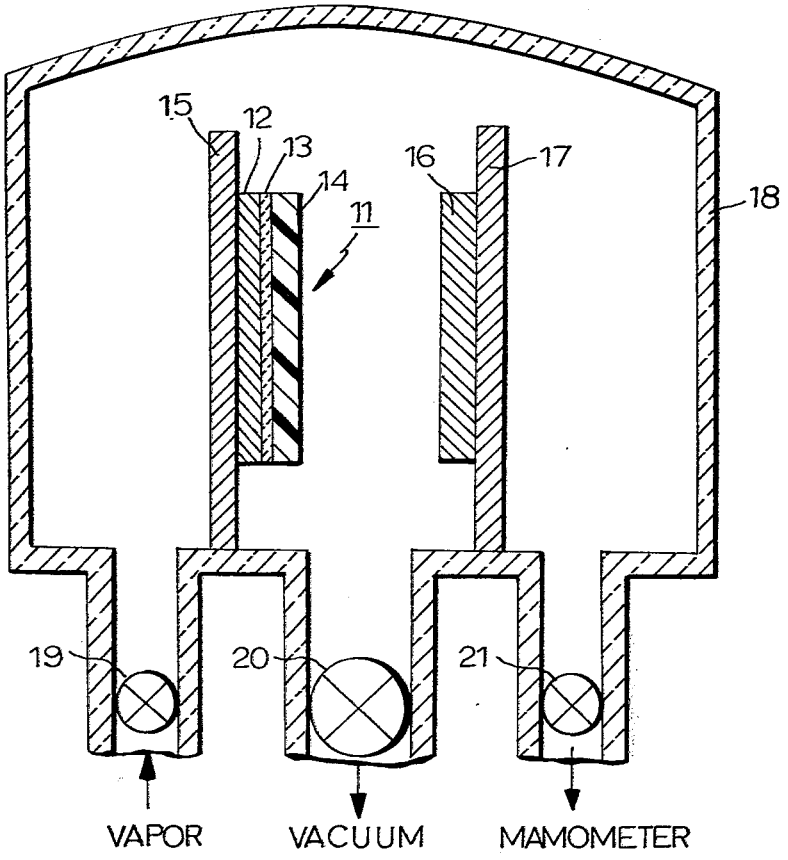
FIG. 1 is a schematic diagram showing the technique of applying a film to an object by glow discharge in a vacuum.

FIG. 1 is a schematic diagram showing the technique of applying a film to an object by glow discharge in a vacuum; The technique (and the apparatus) such as is shown in FIG. 1 is per se well known. This invention improves the reusability of a known electrophotographic plate after repeated uses in a liquid electrophoretic development process by suppressing the residual potential by using the foregoing technique which is well known but has never been used this way before and which has never had attributed to it such unexpected results. Referring to FIG. 1, reference numeral ll designates, as a whole, an electrophotographic photosensitive plate comprising a base which is a conductive substrate 12, a thin vitreous sensitizing layer 13 including selenium, and an organic carrier transporting layer which comprises polyvinylcarbazole or a polyvinylcarbazole derivative which is an electron donor type, and an inactive additive. Reference numeral 15 designates a support for supporting the plate ll. Reference numeral 16 designates an electrode and reference numeral 17 is a support for supporting the electrode 16. Reference numeral 18 designates a vacuum chamber. Reference numeral 19 designates a cock to pass the vapor flow of an organic compound kept in a reservoir (not shown) of the organic compound into the vacuum chamber 18. Reference numeral 20 designates a cock to connect the vacuum chamber with a vacuum pump (not shown). Reference numeral 21 designates a cock to connect the vacuum chamber with a manometer (not shown) to measure the vacuum in the vacuum chamber. By means of the power of a R.F. power supply (not shown) and due to the vacuum, a glow discharge is produced in the vacuum chamber 18. When a vapor of an organic compound is introduced into the vacuum chamber 18 through the cock 19, the organic compound introduced is decomposed and recomposed as a film on the plate ll by the glow discharge. The thus made film is an organic film but it is not fully understood what the structure of the film is. The technique of such a glow discharge (polymerization by glow discharge) is described in "Thin Solid Film" 3, 201 (1969) by A. M. Mearns.

The plate ll is usually made by vacuum depositing the thin layer 13 on the electrically conducting substrate 12, coating a solution of a solvent plus a material to form the layer 14, and drying the coating so as to drive off the solvent and form the layer 14.

The polyvinylcarbazole or a polyvinylcarbazole derivative referred to herein is designated as the polymer of the vinylcarbazole and/or its derivative, or the copolymer of N-vinylcarbazole or its derivative and another vinyl compound, such as vinylacetate and methyl-metha-acrylate. The derivative referred to herein has e.g. a substituent, such as a halogen atom, nitro-radical, alkyl-radical, aryl-radical, alkylaryl-radical, amino radical, or alkyl amino-radical, in place of the hydrogen atom in the carbazole ring in the recurring unit of the above mentioned polymers. The number and the position of the substituents in the carbazole ring and the polymerization degree of the resultant polymer are determined by their preparation and are not limited to those expressly disclosed herein.

It has been well known that a plain polyvinylcarbazole layer is brittle and must be combined with at least one inactive additive as employed in the plate used in this invention. Known inactive additives are, for example, epoxy resin, dioctylphthalate, o-terphenyl, polycarbonate resin, isocyanate and cyanoethylcellulose.

The preferable thickness of layer 14 is about $0.5\mu$ to $50\mu$.

The layer 13 preferably comprises vitreous selenium or a vitreous selenium-tellurium alloy consisting of 60 to 99 weight % of selenium and 40 to 1 weight % of tellurium, and the preferable thickness of the layer 13 is $0.05\mu$ to $3\mu$. Instead of using the electrode 16, another electrophotographic photosensitive plate similar to the plate ll can be used at the position of the electrode 16. The plate ll is preferably positioned at a distance of a few centimeters (usually 1 to 9 cm) from the electrode 16. The pressure of the vacuum is preferably lower than $10^{-1}$ mmHg. The pressure of the vapor of the organic compound coming from the cock 19 is preferably between 1 mmHg and $10^{-1}$ mmHg. The frequency of the R.F. field supplied by the power supply is preferably 50 Hz to 20 MHz. Preferable organic compounds to be vaporized are alcohols, ethers, ester, hydrocarbons and organosilicon compounds. Among them, the most preferable ones are butylalcohol, ethylene-glycol-mono-ethyl ether, iso-amylacetate, isoparaffin and octamethyl-trisiloxane. Other organic compounds which can be vaporized are styrene, MMA, MA, toluene, benzene, p-xylene, hexane, isoprene, acetonitrile, vinylchloride, tetrabutyltin, divinylbenzene, 1,2-dibromoethane, ethylene, acetylene, propylene, butadiene, 1,2-dichloroethane, 1,1,2,2-tetrachloroethylene, tetrafluoroethylene, perfluoropropionitrile, 4-vinylpyridine, trimethylborate, borazine, tris-B-diethylaminoborazine, diphenyl-diethoxysilane, hexamethyldisiloxane, vinyltrimethylsilane, tetramethyldisilane chlorobenzene, fluorobenzene acetophenone, phenylacetylene, nitrobenzene, $\alpha$-methylstyrene, diethylfumarate, tetra-ethoxy-silane, thioacetamide, thiophenol. thianthrene, pyrazole, pyrrole, malononitrile, iminodiacetonitrile, pentane, naphthalene, acrylic acid, allylalcohol, ethylacrylate, acrylate, vinylacetal, isobutene, isoprene, dicyclopentadiene and mixtures thereof.

Figure 2:
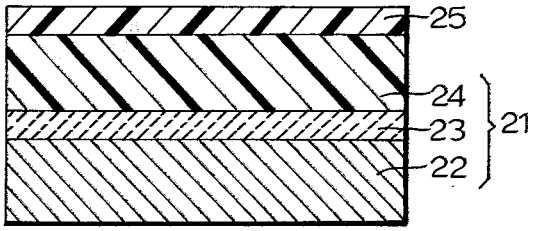
FIG. 2 is a cross-sectional view of an electrophotographic photosensitive plate to which a top organic film has been applied by glow discharge in a vacuum chamber as shown in FIG. 1.

FIG. 2 shows an electrophotographic photosensitive plate 21 made by the method of this invention which comprises, in the order from the bottom up, an electrically conductive substrate 22, a thin vitreous sensitizing layer 23, an organic carrier transporting layer 24, and a top organic film 25. The substrate 22, layer 23 and layer 24 are parallel to the substrate 12, layer 13 and layer 14 in FIG. 1, respectively. The preferable thickness of the film 25 is from $0.1\mu$ to $1\mu$.

Figure 3:
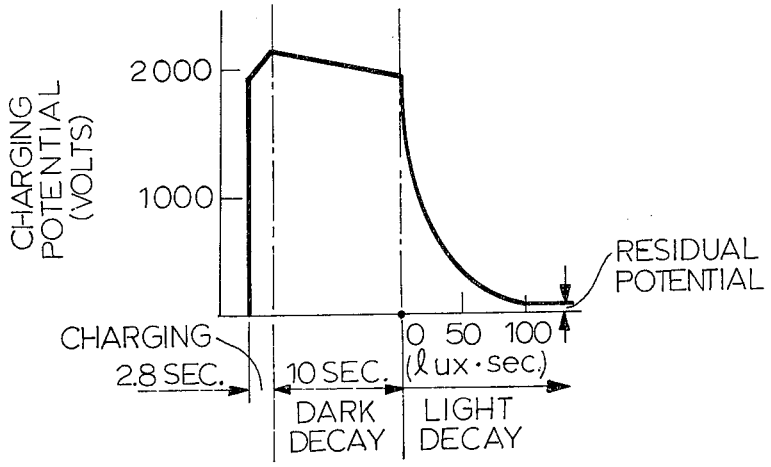
FIG. 3 is a graph showing the electrophotographic characteristic of an electrophotographic photosensitive plate to which a top organic film has been applied by glow discharge in a vacuum as shown in FIG. 2.

FIG. 3 shows the electrophotographic characteristic of an electrophotographic photosensitive plate treated by the method of this invention (i.e., to which a top organic film has been applied by glow discharge in a vacuum chamber) after the plate thus treated is immersed in a liquid (e.g., Isopar H) for liquid electrophoretic development for ten days and is subjected to repeated (e.g. 1000 times) electrophotographic processes (charging-dark decay-light decay).

Figure 4:
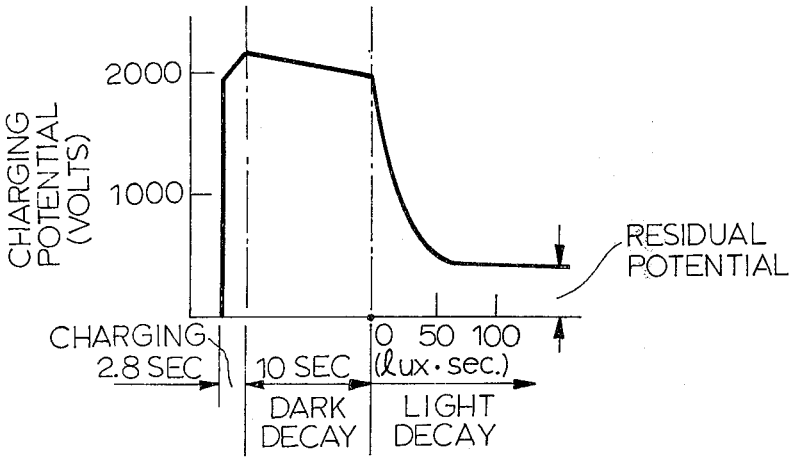
FIG. 4 is a graph showing the electrophotographic characteristic of the electrophotographic photosensitive plate without the top organic film formed by glow discharge in a vacuum.

FIG. 4 shows the electrophotographic characteristic of a typical conventional electrophotographic photosensitive plate (i.e. the plate the same as shown in FIG. 2 without the film 25) after such plate is immersed in the same liquid for liquid electrophoretic development for the same period and is subjected to the same electrophotographic processes the same number of times. As is apparent from FIGS 3 and 4, the method of this invention is very effective for suppressing the residual potential, after repeated use, of an electrophotographic photosensitive plate for use in a liquid electrophoretic development process.

This invention will be understood more readily with reference to the following Examples 1–5, but these Examples are intended only to illustrate the invention, and are not be construed as limiting the scope of this invention.

EXAMPLE 1

An electrically conducting substrate of $76\mu$ thickness was prepared which was composed of a polyester film of $75\mu$ in thickness and an aluminum layer of $1\mu$ in thickness. Selenium was vacuum-evaporated on the aluminum layer to form a thin vitreous selenium layer ($0.3\mu$ in thickness). A solution consisting of 100g of poly-N-vinylcarbazole, 30g of polycarbonate (Panlite L 1250: trade name of Teijin Co., Tokyo, Japan), 50g of O-terphenyl, 3g of diphenylmethandi-isocyanate (Millionate MR: trade name of Nippon Polyurethane Co., Tokyo, Japan), 900g of monochlorobenzene and 300 g of dichloroethane was prepared, applied onto the thin selenium layer and dried. The dry thickness of the solution layer (organic carrier transporting layer) was $15\mu$. Thus, an electrophotographic photosensitive plate was made. For comparison, one more electrophotographic photosensitive plate was made in exactly the same manner. One of the thus made two electrophotographic photosensitive plates and a further aluminum plate (electrode) of 1 mm in thickness were positioned vertically in a vacuum chamber, substantially parallel to each other and with a space of about 5 cm therebetween. Then a vacuum of $10^{-1}$ mmHg was produced in the vacuum chamber. A vapor of a monomer (ethylene-glycol-monoethyl-ether) at 1 mmHg vapor pressure was introduced into the vacuum chamber. Electric power of about 25 mA peak to peak current, about 1000 V peak to peak voltage and at a frequency of about 10 KHz was applied between the conducting layer of the electrophotographic photosensitive plate and the further aluminum plate (electrode) so as to produce a glow discharge in the vacuum chamber. The glow discharge was maintained for about 10 minutes. The thus treated electrophotographic photosensitive plate (Sample A) and the other electrophotographic photosensitive plate made for comparison (Sample B) were subjected to an electrophotographic process (charging-dark decay-light decay) for measurements of eletrophotographic characteristics. Both Samples A and B had similar initial electrophotographic characterisitics such as shown in FIG. 3. Then, Samples A and B were immersed in Isopar H for ten days, and an electrophotographic process (chargingdark decay-light decay) was repeated 10000 times with both Samples A and B. The electrophotographic characteristics of Sample A as then measured were substantially unchanged from the initial ones, whereas the electrophotographic characteristics of Sample B as then measured were greatly changed from the initial ones. Particularly, the residual potential of Sample B increased very much due to the repeated use. Besides, Sample A had a bending strength much higher than that of Sample B. This was found as follows. Two plates the same as Samples A and B, respectively, were prepared in the same manner as described above. Each of the thus prepared two plates was bent around a cylindrical drum, the diameter of which was 40 mm. Then, both plates were immersed in Isopar H. On the surface of the plate the same as Sample B, many cracks of parallel strip shape each strip extending in the direction parallel to the direction of the axis of the cylindrical drum appeared immediately after the plate was immersed in Isopar H, whereas no such cracks appeared in the other plate for two months after it was immersed in Isopar H.

EXAMPLE 2

Samples C and D were made in the same manner as Samples A and B in Example 1, respectively, except that in making Samples C and D, n-butylalcohol was used instead of ethyleneglycol-mono-ethyl-ether. Both Samples C and D had similar initial electrophotographic characteristics. Then, Samples C and D were immersed in Isopar G for two months, and an electrophotographic process (charging-dark decay-light decay) was repeated 5000 times with both Samples C and D. The electrophotographic characteristics of Sample C as then measured were substantially unchanged from the initial ones, whereas the electrophotographic characteristics (inter alia residual potential) of Sample D were greatly and undesirably changed due to the repeated use. Besides, Sample C had a bending strength much higher than that of Sample D. That is, two plates the same as Samples C and D, respectively, were prepared in the same manner as described above. Each of the thus prepared two plates was bent around a cylindrical drum, the diameter of which was 114 mm. Then, both plates were immersed in Isopar G. On the surface of the plate the same as Sample D, many cracks of parallel strip shape each strip extending in the direction parallel to the direction of the axis of the cylindrical drum appeared immediately after the plate was immersed in Isopar G, whereas no such cracks appeared in the other plate for two months after it was immersed in Isopar G.

EXAMPLE 3

Samples E and F were made in the same manner as Samples A and B in Example 1, respectively, except that in making Samples E and F, a selenium-tellurium alloy (25 weight % tellurium) was used instead of selenium, and Isopar e (isoparaffin) was used instead of ethylene glycol-mono-ethyl-ether. Both Samples E and F had similar initial electrophotographic characteristics. Then, Samples E and F were immersed in Isopar H for two months, and an electrophotographic process (charging-dark decay-light decay) was repeated 5000 times. The electrophotographic characteristics of Sample E as then measured were substantially unchanged from the initial ones, whereas the electrophotographic characteristics of Sample F were changed. Particularly, the residual potential of Sample F increased greatly due to the repeated use.

EXAMPLE 4

Samples G and H were made in the same manner as Samples A and B in Example 1, respectively, except that in making Samples G and H, brominated poly-N-vinylcarbazole was used instead of poly-N-vinylcarbazole, and iso-amyl-acetate was used instead of ethylene-glycol-mono-ethyl-ether. Both Samples G and H had similar initial electrophotographic characteristics. Then, Samples G and H were immersed in Isopar H for ten days, and an electrophotographic process (charging-dark decay-light decay) was repeated 1000 times with samples G and H. The electrophotographic characteristics of Sample G as then measured were substantially unchanged from the initial ones, whereas the electrophotographic characteristics of Sample H were changed, and inter alia the residual potential of Sample H increased undesirably.

EXAMPLE 5

Three electrophotographic photosensitive plates were made in the same manner as Sample B in Example 1, except that in making these three plates, 30 g of O-terphenyl was used instead of 50g of O-terphenyl, and further 20g of Hisol SAS-LH (trade name of Nippon Sekiyu Kagaku Co., Ltd.,Japan) was added to the solution. Two of the thus made three plates were positioned vertically in a vacuum chamber, substantially parallel to each other and with a distance of about 5 cm therebetween. Then a vacuum of $10^{-1}$ mmHg was produced in the vacuum chamber. A vapor of a monomer (octamethyl-trisiloxane) at 1 mmHg vapor pressure was introduced into the vacuum chamber. Electric power of about 25 mA peak to peak current, about 1000 V peak to peak voltage and at a frequency of about 20 KHz was applied between the conducting layers of the two plates so as to form a glow discharge in the vacuum chamber. One (Sample I) of the thus treated two plates and the other (Sample J) of the three plates were subjected to an electrophotographic process (charging-dark decay-light decay) for measuring the electrophotographic characteristics of Samples I and J. Then, Samples I and J were immersed in Shell Sol 71 (trade name of Shell Kagaku Co., Tokyo, Japan) for two months, and an electrophotographic process (charging-dark decay-light decay) was repeated 1000 times with both Samples I and J. The electrophotographic characteristics of Sample I as then measured were substantially unchanged from the initial ones, whereas the electrophotographic characteristics of Sample J as then measured had changed greatly due to the repeated use. Moreover, the mechanical quality of Sample I was much better than that of Sample J.

What is claimed is:

1. A method of suppressing residual charge buildup thus improving the reusablility of a selenium type electrophotographic photosensitive plate for use in a liquid electrophoretic development process, the plate comprising, in the following recited order, a base which is a conductive substrate, a thin vitreous sensitizing layer including selenium, an organic carrier transporting layer comprising a compound taken from the group consisting of polyvinylcarbazole and a polyvinylcarbazole derivative together with an inactive additive, said method comprising applying, by glow discharge in a vacuum chamber, a top organic film to said organic carrier transporting layer.

2. A method according to claim 1, wherein said top organic film is made by: placing in said vacuum chamber said electrophotographic photosensitive plate and an electrode at a distance from said electrophotographic photosensitive plate, applying electric power across said plate and said electrode so as to obtain a glow discharge between said electrode and said electrophotographic photosensitive plate, and introducing into said vacuum chamber a vapor of an organic compound which will decompose in said glow discharge and be recomposed on said plate.

3. A method according to claim 2, wherein said organic compound is a compound selected from the group consisting of alcohols, ethers, esters, hydrocarbons and organic silicon compounds.

4. A method according to claim 2, wherein said organic compound is a compound selected from the group consisting of butylalcohol, ethylene-glycol-mono-ethyl ether, iso-paraffin and octamethyl-tri-siloxane.

5. A method according to claim 1, wherein said top organic film has a thickness of $0.1-1\mu$.

* * * * *